US012029270B2

(12) United States Patent
Jones et al.

(10) Patent No.: US 12,029,270 B2
(45) **Date of Patent: *Jul. 9, 2024**

(54) HARD HAT ATTACHMENT SYSTEM AND SAFTEY EQUIPMENT

(71) Applicant: Milwaukee Electric Tool Corporation, Brookfield, WI (US)

(72) Inventors: Benjamin T. Jones, St. Francis, WI (US); Nicole Z. Summersett, Milwaukee, WI (US); Aaron S. Blumenthal, Shorewood, WI (US); Michael Stearns, Milwaukee, WI (US); Steven W. Hyma, Milwaukee, WI (US); McKenzie T. Price, Milwaukee, WI (US); Christopher S. Hoppe, Midvale, UT (US); Grant T. Squiers, Cudahy, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/150,658

(22) Filed: Jan. 5, 2023

(65) Prior Publication Data

US 2023/0148698 A1 May 18, 2023

Related U.S. Application Data

(63) Continuation of application No. 17/103,066, filed on Nov. 24, 2020, now Pat. No. 11,583,023, which is a (Continued)

(51) Int. Cl.
*A42B 3/04* (2006.01)

(52) U.S. Cl.
CPC ..... *A42B 3/0406* (2013.01)

(58) Field of Classification Search
CPC ..... A42B 3/0406; A42B 3/006; A42B 3/04
(Continued)

(56) References Cited

U.S. PATENT DOCUMENTS 3,829,900 A 8/1974 Marangoni
3,877,076 A 4/1975 Summers et al.
(Continued)

FOREIGN PATENT DOCUMENTS

CN 202853494 4/2013
CN 205233577 5/2016
(Continued)

OTHER PUBLICATIONS

International Search Report and Written Opinion for International Application No. PCT/US2019/062464, dated Mar. 10, 2020, 12 pages.

(Continued)

*Primary Examiner* — Timothy K Trieu
(74) *Attorney, Agent, or Firm* — Reinhart Boerner Van Deuren s.c.

(57) ABSTRACT

A hard hat attachment system is described with front, back, and side mounts to support various accessories. Mounts of hard hat receive slots of a bracket that fit around the ridges. Auxiliary ridges receive clips within ports. The user customizes the hard hat for the particular task with the preferred accessories used to complete the job. For example, lamps, face-shields, reflectors, tool carriers, and eyeglass holders are interchangeably releasably coupled to mounting and/or auxiliary ridges on the hard hat. In this way, the hard hat is customized and/or modified to support a wide variety of accessories that are securely and releasably attached to mounting and/or auxiliary ridges without destructive alterations to the hard hat. Brackets couple to mounts and clips couple to ports to secure and/or lock various accessories in (Continued)

place during operation and prevent accidental knocks or jarring the accessory loose.

20 Claims, 16 Drawing Sheets

Related U.S. Application Data continuation of application No. PCT/US2020/060179, filed on Nov. 12, 2020.

(60) Provisional application No. 62/935,387, filed on Nov. 14, 2019.

(58) Field of Classification Search
USPC ..... 2/422
See application file for complete search history.

(56) References Cited

U.S. PATENT DOCUMENTS 4,133,055 A 1/1979 Zebuhr
4,307,471 A 12/1981 Lovell
4,996,724 A 3/1991 Dextrase
5,181,279 A 1/1993 Ross
5,890,232 A 4/1999 Park
6,260,212 B1 7/2001 Orotelli et al.
6,425,141 B1 7/2002 Ewing et al.
6,782,240 B1 8/2004 Tabe
7,028,344 B2 4/2006 Toth
7,116,941 B1 10/2006 Tabe
7,271,720 B2 9/2007 Tabe
7,769,342 B2 8/2010 Tabe
7,802,320 B2 9/2010 Morgan
7,872,575 B2 1/2011 Tabe
7,904,971 B2 3/2011 Doria et al.
7,963,426 B2 6/2011 Gruebel et al.
8,099,054 B2 1/2012 Tabe
8,117,676 B1 2/2012 Cardoso
8,117,677 B2 2/2012 Toth
8,566,968 B2 1/2013 Marzec et al.
8,533,869 B1 9/2013 Capuano
8,613,114 B1 12/2013 Olivares Velasco
8,631,518 B1 1/2014 Jennings
8,661,570 B2 3/2014 Huh
8,667,617 B2 3/2014 Glezerman et al.
8,677,516 B2 3/2014 Prendergast
8,698,634 B2 4/2014 Guedes Lopes Da Fonseca et al.
8,763,166 B1 7/2014 Olivares Velasco
8,844,066 B1 9/2014 Whitcomb
8,898,818 B1 12/2014 Whitcomb
8,908,389 B2 12/2014 Teetzel
8,955,169 B2 2/2015 Weber et al.
8,966,672 B2 3/2015 Smith
8,997,265 B2 4/2015 Olivares Velasco
9,101,175 B2 8/2015 Redpath
9,131,743 B2 9/2015 Marzec et al.
9,173,445 B1 11/2015 Whitcomb
9,311,801 B2 4/2016 Cholhan et al.
9,370,214 B1 6/2016 Whitcomb
9,370,216 B2 6/2016 Brantley
9,380,823 B2 7/2016 Johnson
9,474,318 B2 10/2016 Wesson et al.
9,480,294 B2 11/2016 Occhipinti
9,532,621 B2 1/2017 Redpath
9,751,484 B2 1/2017 Johnson
9,569,951 B2 2/2017 Cholhan et al.
9,572,391 B2 2/2017 McInnis et al.
9,702,534 B1 7/2017 Brion
9,713,355 B2 7/2017 Daoust
9,717,297 B2 8/2017 Harris
9,795,178 B2 10/2017 Suddaby
9,795,180 B2 10/2017 Lowe et al.
9,820,524 B1 11/2017 Whitcomb
9,820,525 B2 11/2017 Weber et al.
9,848,666 B1 12/2017 Egeland et al.
9,901,125 B2 2/2018 Insley et al.
9,922,536 B2 3/2018 Cholhan et al.
9,975,032 B2 5/2018 Frey
9,978,247 B2 5/2018 Alampallam et al.
9,980,531 B2 5/2018 Suddaby
10,105,584 B1 10/2018 Whitcomb
10,140,841 B2 11/2018 Cholhan et al.
10,165,818 B2 1/2019 Suddaby
10,206,447 B2 2/2019 Egeland et al.
10,219,572 B1 3/2019 Whitcomb
10,235,857 B2 3/2019 Jones
10,269,232 B2 4/2019 Rachakonda et al.
10,278,445 B1 5/2019 Whitcomb
10,349,686 B2 7/2019 Insley et al.
10,363,477 B1 7/2019 Whitcomb
10,373,480 B2 8/2019 Cholhan et al.
10,405,598 B2 9/2019 Gotti
10,463,099 B2 11/2019 Allen et al.
10,463,100 B2 11/2019 Gotti
10,515,521 B2 12/2019 Klein et al.
10,535,242 B2 1/2020 Rahman et al.
10,535,249 B2 1/2020 Cholhan et al.
10,575,579 B2 3/2020 Egeland et al.
2001/0024949 A1 9/2001 Yanagida et al.
2007/0094268 A1 4/2007 Tabe
2007/0212930 A1 9/2007 Gruebel et al.
2009/0077721 A1 3/2009 Prendergast
2009/0126059 A1 5/2009 Tack et al.
2010/0299813 A1 12/2010 Morgan
2011/0113535 A1 5/2011 Lebel et al.
2011/0179557 A1 7/2011 Rabie
2011/0203038 A1 8/2011 Jones, Jr.
2011/0209272 A1 9/2011 Drake
2012/0060251 A1 3/2012 Schimpf
2012/0073034 A1 3/2012 Gafforio et al.
2012/0176237 A1 7/2012 Tabe
2012/0210498 A1 8/2012 Mack
2012/0272435 A1 11/2012 Glezerman et al.
2012/0296974 A1 11/2012 Tabe
2013/0086722 A1 4/2013 Teetzel
2013/0232668 A1 9/2013 Suddaby
2014/0000013 A1 1/2014 Redpath et al.
2014/0007323 A1 1/2014 Capuano
2014/0033402 A1 2/2014 Donnadieu et al.
2014/0130240 A1 5/2014 Olivares Velasco
2014/0143931 A1 5/2014 Olivares Velasco
2014/0143938 A1 5/2014 Olivares Velasco
2014/0143939 A1 5/2014 Olivares Velasco
2014/0345036 A1 11/2014 Sargenti et al.
2014/0352038 A1 12/2014 Harris
2015/0020295 A1 1/2015 Olivares Velasco
2015/0143617 A1 5/2015 Suddaby
2015/0305425 A1 10/2015 Redpath et al.
2015/0347600 A1 12/2015 Tabe
2016/0174626 A1 6/2016 Mazzarolo et al.
2016/0219964 A1 8/2016 Pisano
2016/0278467 A1 9/2016 Irwin
2016/0316847 A1 11/2016 Weber et al.
2017/0112221 A1 4/2017 Gotti
2017/0164677 A1 6/2017 Olivares Velasco
2017/0169533 A1 6/2017 O'Brien
2017/0206534 A1 7/2017 O'Brien
2017/0224030 A1 8/2017 Olivares Velasco
2017/0243457 A1 8/2017 Milbrand
2017/0251744 A1 9/2017 Suddaby
2017/0309152 A1 10/2017 Dinkins
2017/0367433 A1 12/2017 Frett
2018/0070667 A1 3/2018 Weber et al.
2018/0098594 A1 4/2018 Marcus
2018/0153244 A1 6/2018 Kirshon
2018/0160760 A1 6/2018 Suddaby
2018/0292178 A1 10/2018 Gehring et al.
2018/0295188 A1 10/2018 Bahners et al.
2018/0338561 A1 11/2018 Destrian et al.
2019/0008228 A1* 1/2019 Ramey ..... A42B 1/24
2019/0082766 A1 3/2019 Suddaby
2019/0104795 A1* 4/2019 Tirado ..... A42B 3/0453
2019/0231016 A1 8/2019 Deshpande et al.

(56) References Cited

U.S. PATENT DOCUMENTS

| | | | |
|---|---|---|---|
| 2019/0297985 | A1 | 10/2019 | Weber et al. |
| 2019/0313710 | A1 | 10/2019 | Insley et al. |
| 2019/0333178 | A1 | 10/2019 | Cheng et al. |
| 2019/0355232 | A1 | 11/2019 | Cholhan et al. |

FOREIGN PATENT DOCUMENTS

| | | |
|---|---|---|
| CN | 107981456 | 5/2018 |
| JP | 2009-127187 | 6/2009 |
| JP | 2018-087401 | 6/2018 |
| KR | 20-2013-0003414 | 6/2013 |
| WO | WO07067133 | 6/2007 |
| WO | WO09141474 | 11/2009 |
| WO | WO14049187 | 4/2014 |
| WO | WO17083883 | 5/2017 |
| WO | WO19175084 | 9/2019 |

OTHER PUBLICATIONS

International Search Report and Written Opinion for International Application No. PCT/US2020/060179, dated Mar. 12, 2021, 9 pages.

Photos of Zenith helmet from KASK S.p.a believed to be commercially available prior to Nov. 21, 2018, 4 pages.

* cited by examiner

HARD HAT ATTACHMENT SYSTEM AND SAFTEY EQUIPMENT

CROSS-REFERENCE TO RELATED PATENT APPLICATIONS

The present application is a continuation of U.S. application Ser. No. 17/103,066, filed on Nov. 24, 2020, which is a continuation of International Application No. PCT/US2020/060179, filed on Nov. 12, 2020, which claims the benefit of and priority to U.S. Provisional Application No. 62/935,387 filed on Nov. 14, 2019, which are incorporated herein by reference in their entireties.

BACKGROUND OF THE INVENTION

The present invention relates generally to the field of safety equipment. The present invention relates specifically to a hard hat, ear protection, face mask, and/or hard hat lamp attachment system. Hard hats are often used in loud or poorly illuminated areas. Hard hat use in high-risk environments for head or face injury may use added equipment (e.g., earmuffs or a face protector) to provide added protection. A lamp or flashlight may assist with vision in poorly lit or low visibility environments. Ear protection is used to protect a user's hearing in noisy environments.

SUMMARY OF THE INVENTION

One embodiment of the invention relates to a hard hat attachment system. The hard hat includes a mount and side accessory ridge. The system includes a mounting bracket and side clips or inserts that couple to the mount and accessory ridge of the hard hat. The mounting bracket is configured to be securely and removably coupled to the mount of the hard hat. One or more inserts are configured to couple to the accessory ridge of the hard hat. The mounting bracket has receiving ports to receive an edge of the mount and secure the mounting bracket to the hard hat. The accessory ridge includes side receiving ports to receive one or more inserts and secure an attachment to the hard hat.

In various embodiments, the system connects an accessory, e.g., a lamp, a face-shield, a reflector, a magnetic tool carrier, and/or an eyeglass holder to either the mounting bracket and/or the accessory ridge of the hard hat. The accessory is removably coupled and secured to the hard hat. For example, the mounting bracket secures to the mount of the hard hat. Similarly, a side clip couples to receiving ports on the accessory ridge of the hard hat.

In various embodiments, the hard hat includes first and second mounts. The first mount is located along the front surface of the hard hat, and the second mount is located along the rear surface of the hard hat. This allows a user to attach accessories to both the front and rear of the hard hat. In some embodiments, the hard hat includes side accessory ridges for mounting various accessories to a side of the hard hat.

In various embodiments, ear protection (e.g., earmuffs) is configured for attachment to a hard hat. In various embodiments, a face mask is configured for attachment to a hard hat.

Another embodiment of the invention relates to a hard hat. An outer shell of the hard hat forms an exterior surface and an interior surface that defines a cavity configured to receive a head of an operator. a crown segment of the outer shell covers part of the head of the operator and a bottom portion of the crown segment defines a lower circumference along the exterior surface of the outer shell. A brim extends radially outward from at least a portion of the lower circumference. A side accessory ridge is coupled to a lateral side of the bottom portion of the crown segment. The side accessory ridge has a front accessory port with a first length, a middle accessory port with a second length, and a rear accessory port having a third length. The second length is different from the first length and the third length.

Another embodiment of the invention relates to a hard hat. The hard hat forms an outer shell with an exterior surface and an interior surface that defines a cavity configured to receive a head of an operator. A crown segment of the outer shell covers part of the head of the operator, and a bottom portion of the crown segment defines a lower circumference along the exterior surface of the outer shell. A brim extends radially outward from at least a portion of the lower circumference. The hard hat has a side accessory ridge located between the brim and the bottom portion of the crown segment. The side accessory ridge includes a front port, a rear port, and a middle port. The front port and the rear port are smaller than the middle port.

Another embodiment of the invention relates to a hard hat with an outer shell. The outer shell has left and right lateral outer surfaces and an interior surface that defines a cavity that receives an operator's head. A crown segment of the outer shell covers part of the operator's head and a bottom portion of the crown segment defines a lower circumference along the outer surfaces of the outer shell. A brim extends radially outward from at least a portion of the lower circumference. The hard hat includes left and right side accessory ridges. The left side accessory ridge is located on the left lateral outer surface of the outer shell. The left side accessory ridge has a front left side accessory port with a first length, a middle left side accessory port with a second length, and a rear left side accessory port with a third length. Similarly, the right side accessory ridge is located on the right lateral outer surface of the outer shell. The right side accessory ridge includes a front right side accessory port with the first length, a middle right side accessory port with the second length, and a rear right side accessory port with the third length. The second length is different from both the first length and the third length.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
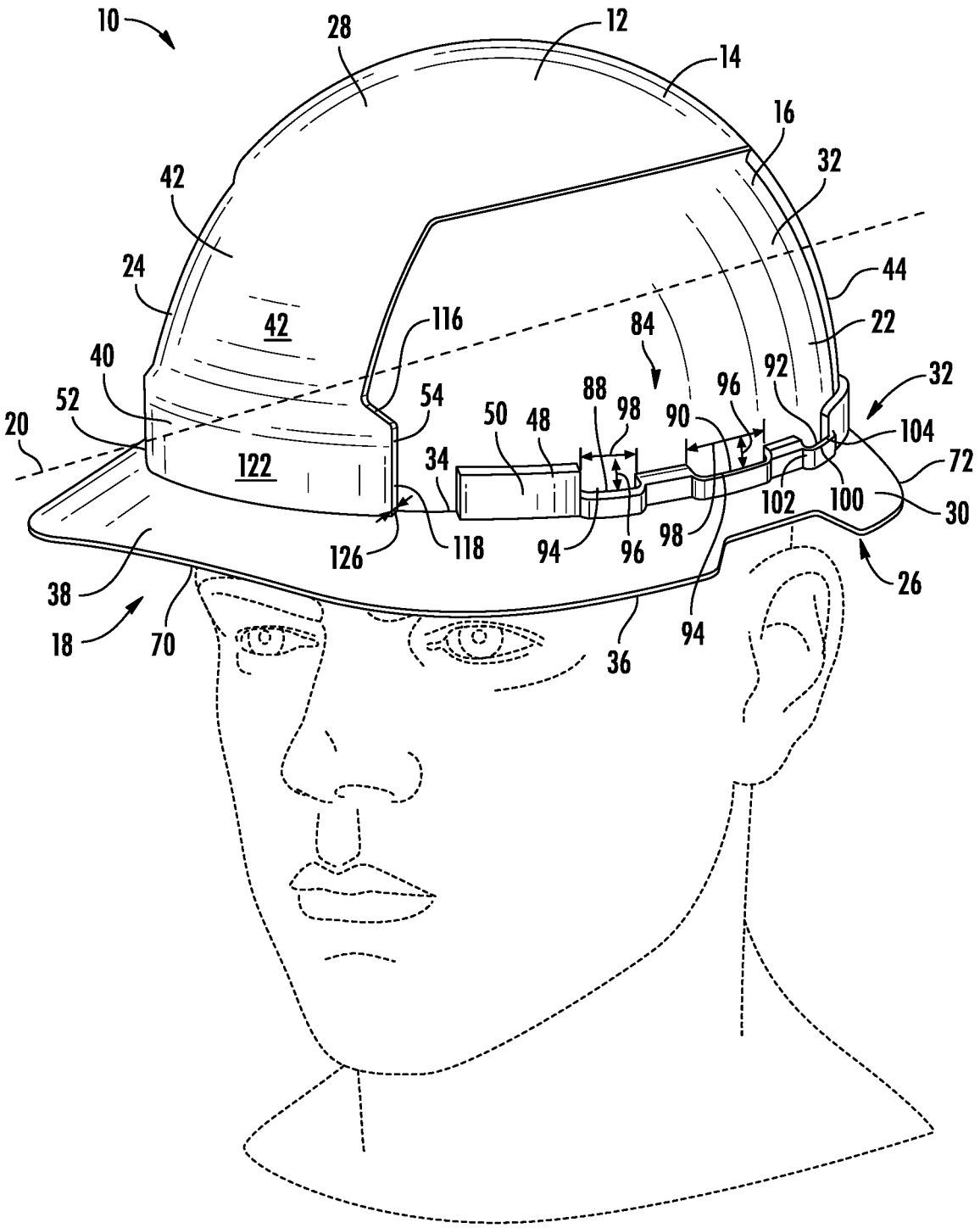
FIG. 1 shows a hard hat with a forward accessory mount worn with the brim facing forward, according to an exemplary embodiment.

Referring generally to the figures, various embodiments of a hard hat attachment system are shown. Hard hats are used in a variety of construction sites and/or other situations. Hard hats are often used in loud, noisy, dim, and/or poorly lit environments. In conventional lamp attachment systems, an operator couples an accessory to a hard hat via a strap wrapped around the hardhat or fastener. Some operators mount accessories onto a mounting clip secured to the hardhat through destructive means such as drilling and bolting the mounting clip and attaching the accessory to the clip. Adding a rigid mount may compromise the safety rating and/or warranty of the hard hat.

In contrast, the hard hat system discussed herein utilizes a universal accessory mounting system that includes mounts or locations and side accessory ridges or an auxiliary ridge on the hard hat. The mounting and auxiliary ridges allow for customized and secure attachment of accessories to the hard hat without end-user alteration of the hard hat structure. Specifically, the hard hat attachment system discussed herein utilizes one or more mounting and/or side accessory ridges formed on the outer or exterior surface of the hard hat to interchangeably couple a variety of accessories to assist in a variety of environments that the hard hat may be used. Mounting brackets and/or clips are securely and removably coupled to the mounting and/or side accessory ridges to secure the accessories. In this manner, earmuffs, lamps, face-shields, reflectors, magnetic tool carriers, and/or eyeglass holders are attached to the hard hat in a manner that is more secure than a typical strap arrangement. In addition, the removable and secure coupling avoids potential problems associated with mounting systems that involve permanent alteration of hard hat structure to attach accessories.

In addition, because some users wear hard hats backwards (e.g., so the bill of the hard hat does not further interfere with visibility), mounts are added on the front and the back of the hard hat. A user can then wear a first accessory (e.g., a light) on the front of the hard hat, a second accessory (e.g., a reflector) on the back of the hard hat, a third accessory on one side (e.g., a tool carrier), a fourth accessory on another side (e.g., an eyeglass carrier or holder), and/or an accessory on both sides (e.g., earmuffs for the right and left ears). This configuration enhances safety by providing users with accessories specific to the work environment. The accessories chosen in a mine, for example, may be different than the accessories for an operator in a construction area near heavy operating equipment (e.g., a forklift, bulldozer, boom, or other heavy operating equipment).

Referring generally to the figures, a hard hat accessory system 10 is shown and described. A hard hat 12 provides outer shell 14 with an exterior surface 16 and an interior surface 18. Similarly, a midplane 20 divides outer shell 14 into a left lateral outer surface 22 and a right lateral outer surface 24 on each opposite lateral side. Interior surface 18 defines a cavity 26 in hard hat 12 that couples to a suspension system 11 (FIGS. 8-9) to receive and supports hard hat 12 on an operator's head. The outer shell 14 of hard hat 12 includes a crown segment 28 and a brim 30. Crown segment 28 covers a part of the operator's head. Crown segment 28 extends radially around a crown to partially surround the user's head. A bottom portion 32 of crown segment 28 either extends away from the user's head to form brim 30 or terminates to form an edge 36 of outer shell 14. Bottom portion 32 defines a lower circumference 34 extending along exterior surface 16, where outer shell 14 extends away from the user's head to form brim 30. Brim 30 extends radially outward from lower circumference 34 and partially or completely surrounds lower/bottom portion 32. Stated differently, brim 30 extends away from crown segment 28 to extend an edge 36 of outer shell 14 for at least a portion of the lower circumference 34. In some embodiments, brim 30 only includes a front bill 38, and edge 36 of outer shell 14 is collinear with lower circumference 34.

In various embodiments, hard hat 12 includes a variety of mounting ridges, location, or mounts 40 (e.g., front and/or rear mounts 42 and/or 44) and/or side accessory/auxiliary support ridges or side accessory ridges 50 (e.g., right and/or left accessory ridges 46 and/or 48) to mount various attachments 56. Front and rear mounts 42 and 44 have opposite right and left edges 52 and 54 protruding outwardly from each mount 40. In one embodiment, right edge 52 and left edge 54 on front mount 42 are the same size and shape as left edge 54 and right edge 52 on rear mount 44.

As used herein, the description for mount 40 applies equally to front mount 42 and rear mount 44, unless expressly indicated otherwise. Unless indicated, the description for front mount 42 applies to rear mount 44 and vice versa. Similarly, side accessory ridge 50 refers to an accessory ridge on either the right and/or left sides of outer shell 14. Right accessory ridge 46 and left accessory ridge 48 are identified as right or left the accessory ridges 50; however, unless expressly indicated otherwise, the description for one accessory ridge 50 applies to either ridge 46 and/or 48. Accessories or attachments 56 generally include a lamp 58, a face-shield 60, earmuffs 62, a reflector 64, a magnetic tool carrier 66, and/or an eyeglass holder 68.

Figure 2:
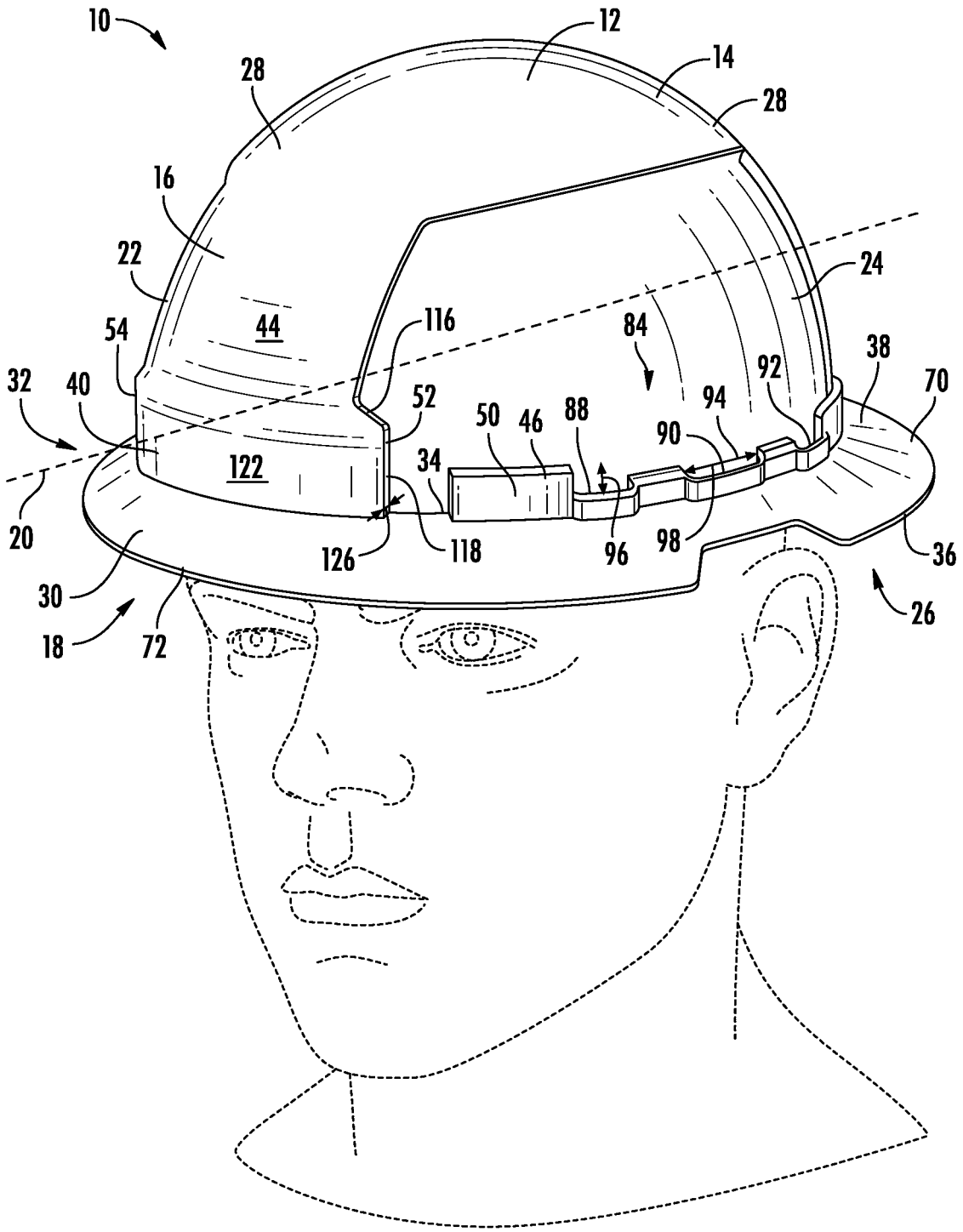
FIG. 2 shows a hard hat with a rear accessory mount worn with the brim facing backward, according to an exemplary embodiment.

Referring to FIG. 1, an operator is shown wearing hard hat 12. As illustrated, hard hat 12 is oriented in a forward-facing direction with a front mount 42 above a bill 38 of the front end 70 of hard hat 12. In this configuration, bill 38 on the front end 70 of hard hat 12 shields the operator's eyes. The back end 72 is in the back of the head. Referring to FIG. 2, the operator can reverse hard hat 12 such that the front end 70 is on the back of the head, and the back end 72 is above the eyes of the operator. A rear mount 44 is now located above the user's eyes for an accessory or attachment 56 (e.g., lamp 58) to hard hat 12. In both FIGS. 1 and 2 an attachment 56, such as a headlamp (e.g., lamp 58), includes a mounting bracket 74 (FIG. 3) that securely attaches to front or rear mount 42 or 44 of hard hat 12.

Figure 3:
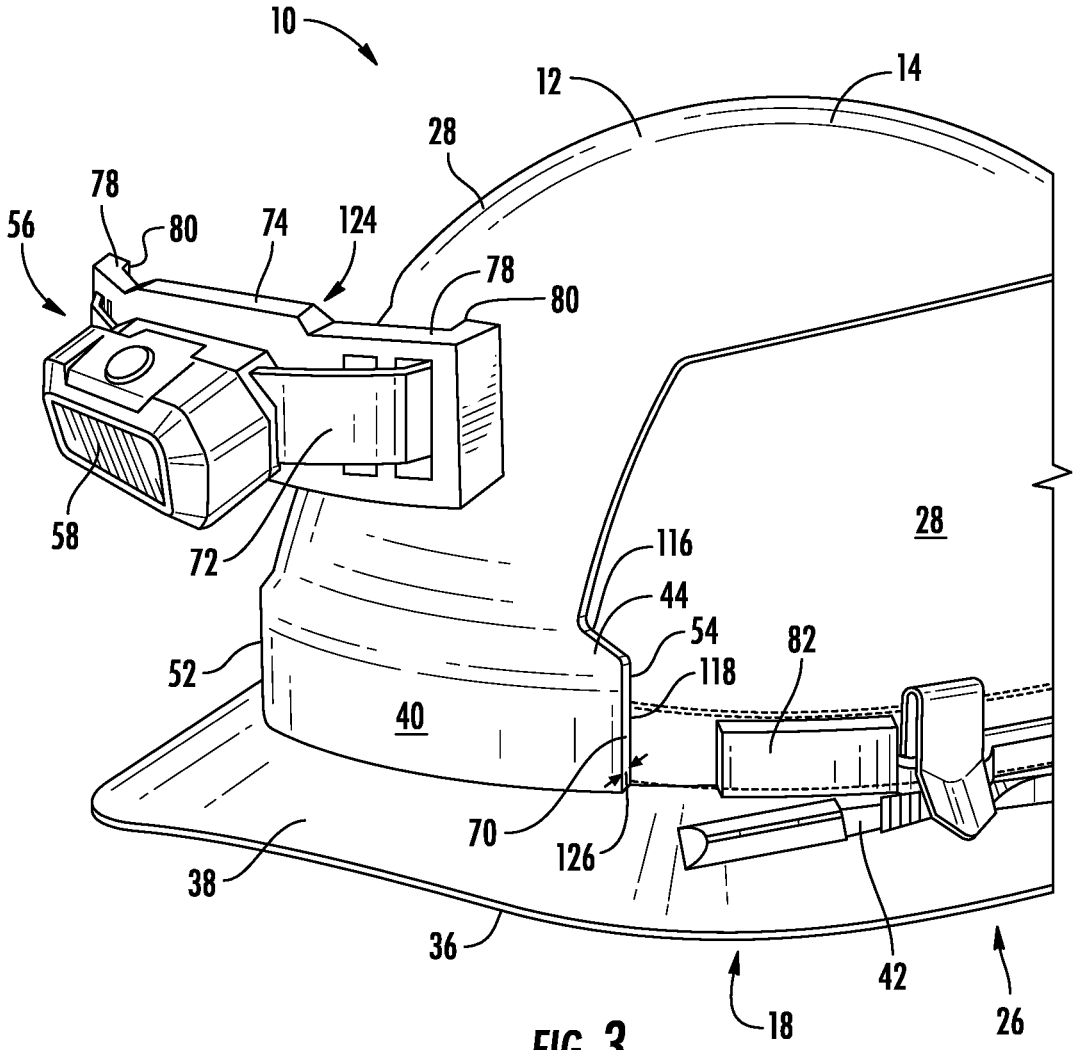
FIG. 3 is a detailed view of a disconnected lamp accessory connected with a bracket at the forward mount, according to an exemplary embodiment.

In some embodiments, the hard hat attachment system includes mounting bracket 74, lamp 58, and a strap 76. FIG. 3 illustrates hard hat 12 of FIGS. 1 and 2 showing attachment of bracket 74 to lamp 58 at mount 40 on hard hat 12. Bracket 74 includes receiving slots 78 and extensions 80 that interface with the front mount 42 or rear mount 44 of hard hat 12. Slots 78 and extensions 80 partially surround edges 52 and 54 on mounts 40 to clamp and secure bracket 74 at the mount 40 of outer shell 14. Bracket 74 provides structural support to lamp 58 and provides a rigid attachment location to secure lamp 58 on hard hat 12. Strap 76 interconnects lamp 58 to bracket 74 and provides a mechanism to attach various lamps 58, including aftermarket lamps 58 with strap 76 receiving locations.

An auxiliary band 82 may wrap around the circumference of hard hat 12 without interfering with the mounting or auxiliary or accessory ridges 50, such as passing through an opening under the right and left accessory ridges 46 and 48. Auxiliary band 82 supports the connection of hand tools or other equipment suitable for storage along bill 38 or accessory ridges 46 and 48 of hard hat 12. Similarly, attachments 56 couple to ports 84 in accessory ridge 50 of hard hat 12. In some embodiments, tools and/or other attachments 56 include a fastener or clip 86 that couples with one or more ports 84. For example, FIGS. 1-2 show a front accessory port 88, a middle accessory port 90, and a rear accessory port 92 of different sizes on a right side accessory ridge 50 and a left accessory ridge 48. In some embodiments, a smaller port (e.g., front port 88 and/or rear port 92) is used for a smaller attachment 56 (e.g., tool carrier 66). Similarly, a larger port (e.g., middle port 90) is used for a larger attachment 56 (e.g., earmuffs 62). For example, front accessory port 88 and rear accessory port 92 are each smaller than middle accessory port 90, which balances attachments to support more weight over a center between the front end 70 and back end 72 of outer shell 14.

Each port 84 (e.g., front, middle, and rear accessory ports 88, 90, and 92) has a size 94 (or area) defined by a width 96 and a length 98 of the port 84. The width of each port 84 is defined radially as the linear distance from lower circumference 34 of outer shell 14 to an inner rim 100 of side accessory ridge 50. Similarly, a length 98 of ports 84 is defined between a forward rim 102 (nearest a front bill 38) and a rear rim 104 (furthest from the front bill 38) of the ports 84. The product of length 98 and width 96 for each port 84 defines an area equal to the size 94 of the port 84.

In various embodiments, each port 84 has a different size 94, width 96, and/or length 98, or some ports 84 have equal widths 96 and/or sizes 94, but variable lengths 98. Specifically, front accessory port 88 and rear accessory port 92 have the same width 96 and/or length 98 (and therefore the same size 94), but a different width 96 and/or length 98 as the middle accessory port 90. For example, the port width 96 is the same (e.g., equal) for front accessory port 88, middle accessory port 90, and rear accessory port 92. In one embodiment, the port width 96 of each port on the left side accessory ridge 50 is the same as the port width 96 of each port 84 on the right side accessory ridge 50.

As illustrated in FIGS. 1-2, middle accessory port 90 has a width 96 that is equal to the front accessory port 88 and the rear accessory port 92, and a length 98 of middle accessory port 90 is greater than a length of either front accessory port 88 or rear accessory port 92. In one embodiment, the length 98 of front accessory port 88 is equal to the length of rear accessory port 92. In other embodiments, the width 96 of each port 84 is the same, but the sizes 94 and/or lengths 98 of the ports 84 vary. For example, the size 94 and/or length 98 of middle accessory port 90 is greater than a size 94 and/or length 98 of either the front accessory port 88 or the rear accessory port 92. In a specific embodiment, front accessory port 88 and rear port 84 have equal size 94 (e.g., the same width 96 and length 98 or different widths 96 and lengths 98 where the products of the widths 96 and lengths 98 are equal).

In various embodiments, hard hat 12 has opposite left and right accessory ridges 50. The left side accessory ridge 50 is located on the left lateral outer surface 22, and the right side accessory ridge 50 is located on the right later outer surface of outer shell 14. Both the left and right accessory ridges 46 and 48 have the front left/right side accessory ports 88 with a first length 98, middle left/right side accessory ports 90 with a second length 98, and rear left/right side accessory ports 92 with a third length 98. In general, the lengths 98 and widths 96 are variable, such that each port 84 has a different size 94, length 98, and/or width 96. In one embodiment, ports 84 have equal widths 96, but second length 98 is different from both the first length 98 and the third length 98.

This configuration enables a uniform system to couple attachments to side accessory ridge 50 of hard hat 12. Side clips of different sizes or shapes are coupled to one of the ports 84 (e.g., front accessory port 88, middle accessory port 90, and/or rear accessory port 92) to couple an attachment 56 to side accessory ridge 50 on a left or right side brim 30 of outer shell 14. For example, earmuffs 62 have a large insert or clip 86 sized for a middle accessory port 90, and a reflector 64 has a clip 86 sized for front and/or rear accessory ports 88 and/or 92.

Using the same width 96 across ports 84 maintains a consistent thickness for clips 86 and having consistently sized ports 84 (e.g., a middle accessory port 90 that has a length 98 that is greater than a length of front accessory port 88 and rear accessory port 92) provides attachment locations to support different sizes and weights of attachments. This configuration creates a uniform mounting system 10 for attachments 56 coupled to any hard hat 12 configured with an appropriately sized mount 40 and/or accessory ridge 50.

Figure 4:
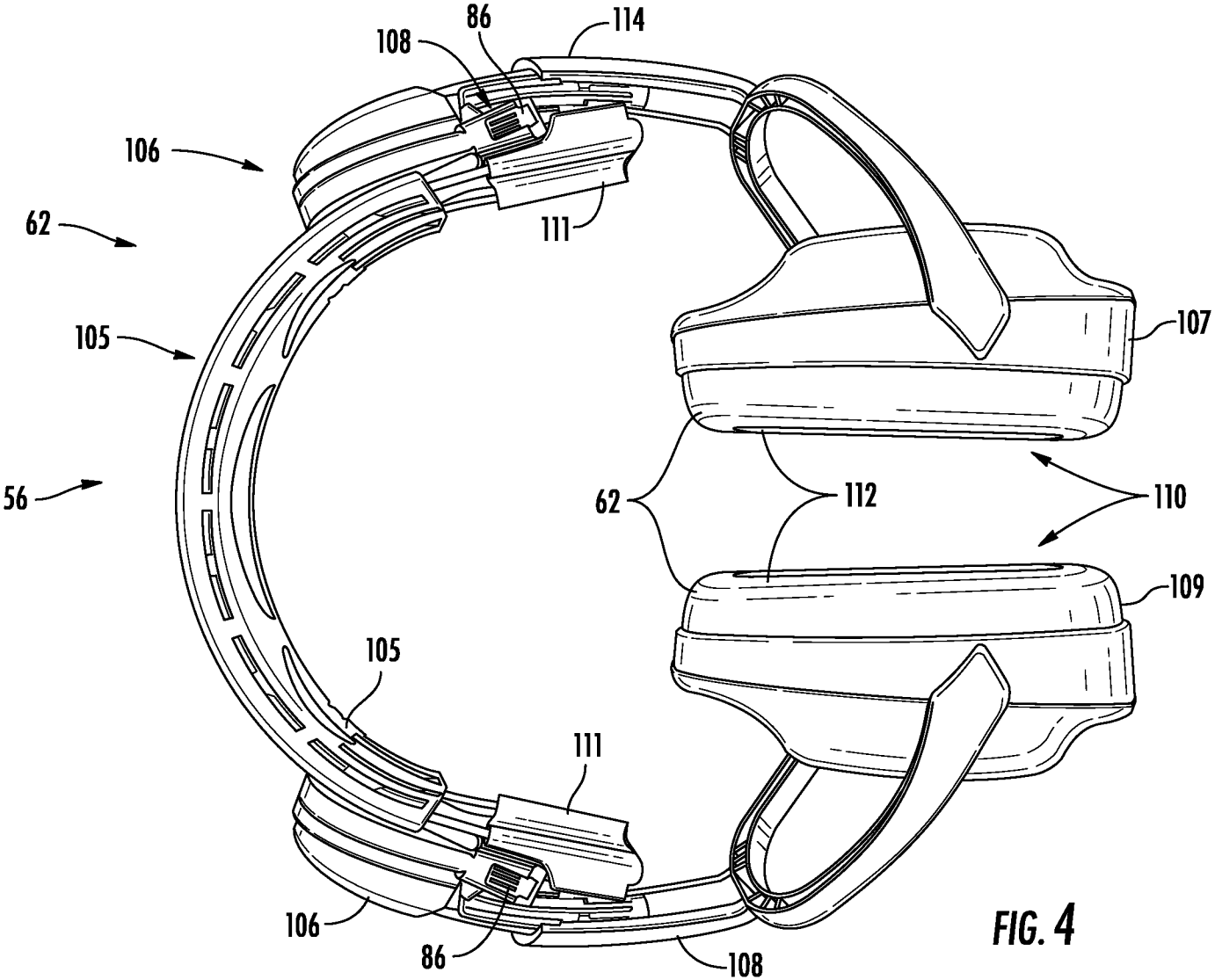
FIG. 4 shows an earmuff accessory with overhead support, according to an exemplary embodiment.

FIG. 4 shows an earmuff 62 configured with overhead support 105 and a swivel 106. In the illustrated embodiment, earmuff 62 includes left/right over-earmuffs 62, a swivel 106, an earmuff connector 108, a headband connector 108, and overhead support 105. Over-earmuff 62 includes acoustic damping materials 110 and a seal 112 that acoustically isolates an operator's ear from the surrounding environment. The over-earmuff reduces the decibel level of surrounding noise in the environment if the over-earmuff 62 is properly constrained against the user's head and over the user's ears. To properly restrain the over-earmuff 62 overhead support 105 traditionally couples right and left over-earmuffs 62. In the embodiment of FIG. 4, swivel 106 is coupled to headband connector 108 and/or earmuff connector 108. For example, overhead support 105 is removably coupled to swivel 106 via headband connector 108, and swivel 106 is removably coupled to over-earmuff 62 via earmuff connector 108.

As described in detail below, this configuration enables a user to use earmuff 62 with an overhead support 105 or to remove overhead support 105 and connect swivels 106 of left ear cuff 107 and right ear cuff 109 directly into port 84 of side accessory ridge 50. Similarly, earmuff connector 108 releasably couples to over-earmuff 62 to attach another accessory to swivel 106. For example, a wireless speaker, a telephone earpiece/receiver, a two-way radio, and/or a microphone. In this way, swivel 106 optionally couples to overhead support 105 and over-earmuff 62 with various features specifically suited for the task the operator wishes to accomplish.

Figure 5:
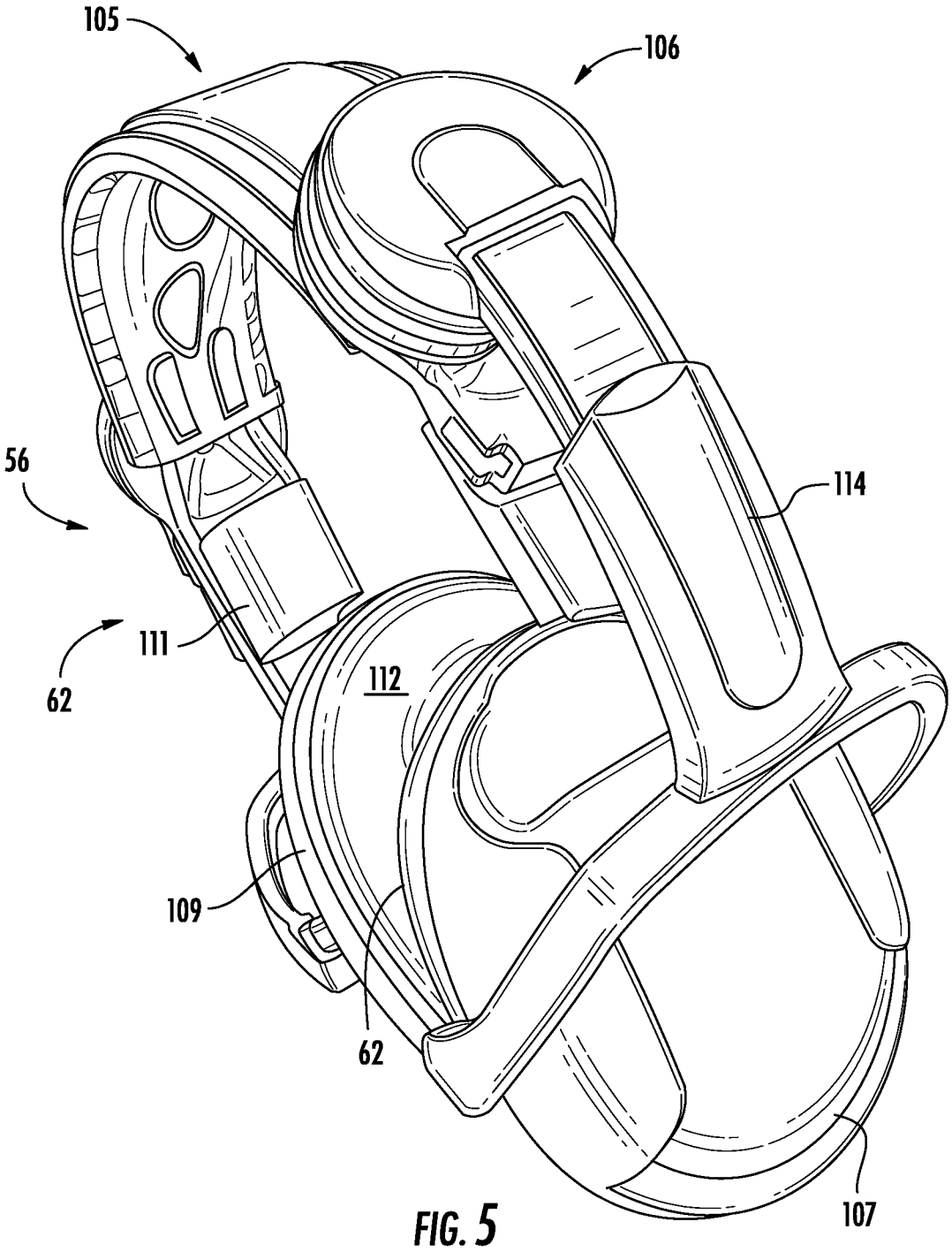
FIG. 5 shows a side view of the earmuff accessory shown in FIG. 4, according to an exemplary embodiment.

FIG. 5 shows a side perspective view of the earmuff 62 of FIG. 4. As shown in FIG. 4, overhead support 105 is coupled to swivel 106, and a sliding adjustment 114 is located between swivel 106 and over-earmuff 62. Sliding adjustment 114 enables over-earmuff 62 to be located relative to swivel 106. For example, sliding adjustment 114 utilizes one length on an operator when used with overhead support 105 and a second length when swivel 106 is coupled to ports 84 on accessory ridge 50. In addition, over-earmuffs 62 may include a variety of features specific to the job. Different over-earmuffs 62 can attach to swivel 106, incorporating either overhead support 105 or attachment to port 84 on accessory support ridge 50.

Figure 6:
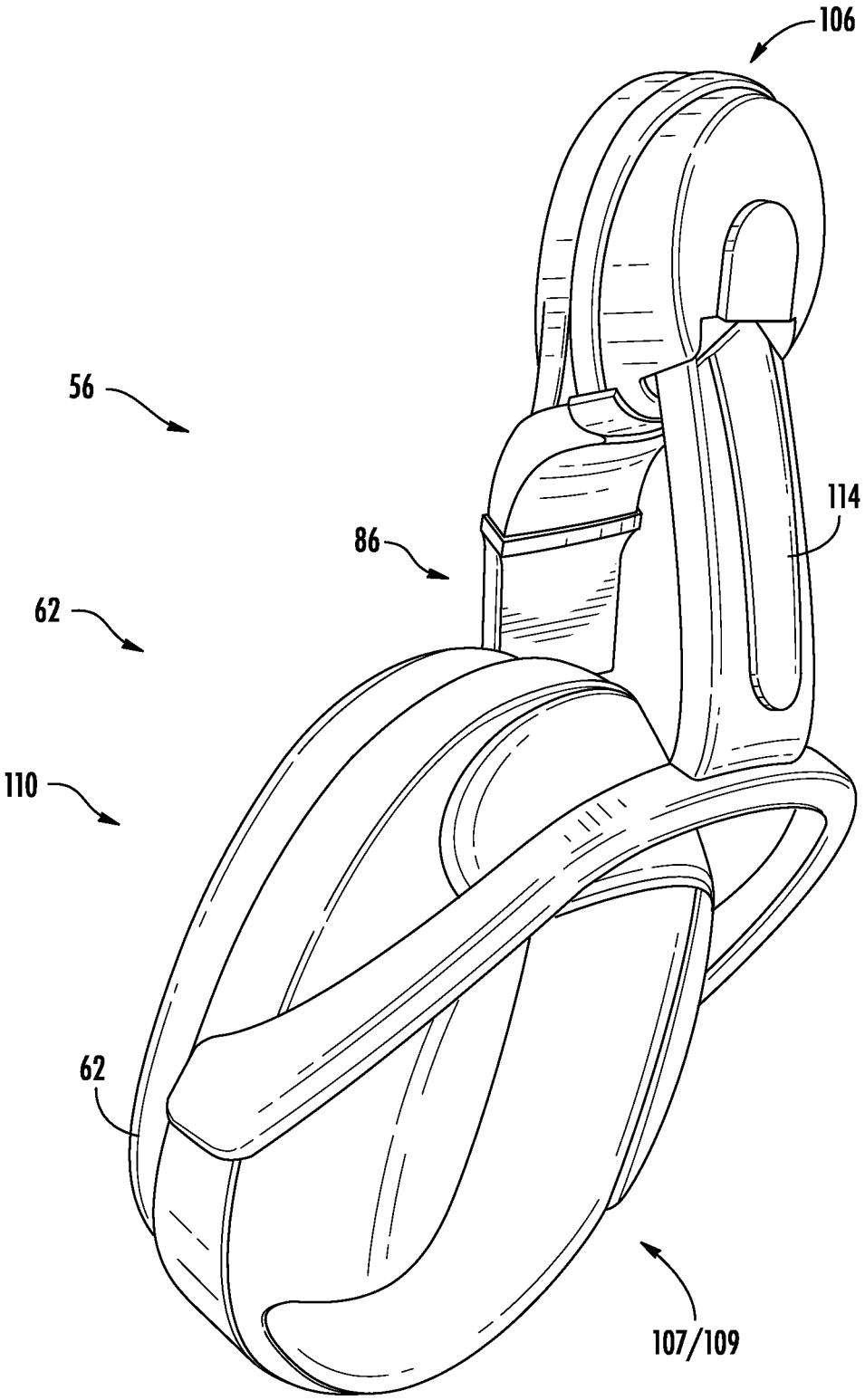
FIG. 6 shows a side view of the earmuff accessory attachment, with the overhead support replaced with a swivel and clip, according to an exemplary embodiment.

FIG. 6 shows earmuff 62 detached from overhead support 105. This view shows a muff attachment or clip 86 that alternatively couples over-earmuff 62 and/or swivel to overhead support 105 or hard hat 12 via port 84. In this way, an operator can choose whether overhead support 105 or hard hat 12 equipment is better suited for the specific task. In addition, replacing over-earmuff 62 with a speaker over-earmuff 62 (or other features, e.g., earphone/microphone) is accomplished by replacing over-earmuff 62 at swivel 106.

As shown in FIGS. 1-3 and 7, hard hat 12 includes mounts 40 with an angled edge or taper 116 and a bevel 118. The taper 116 provides a location to facilitate slipping bracket 74 over the edges 52 and 54 of mount 40. Slots 78 and extensions 80 in bracket 74 are wider than the taper 116 and top of bevel 118 to slide over mount 40 easily. Bevel 118 and taper 116 of mount get thicker/wider, respectively, as bracket 74 slides down mount 40 towards brim 30, securing the joint between bracket 74 and mount 40. Detents and/or protrusions 120 on a front face or forward mounting surface 122 of mounts 40 also interface with openings 124 on bracket 74 to secure bracket 74 to the mount 40.

The angular shape of taper 116 gradually increases the width of edges 52 and 54 on mounts 40 to increase the friction and/or clamping force between slots 78 and extensions 80 on bracket 74 and edges 52 and 54 on mount 40. Similarly, bevel 118 increases a thickness 126 of mount 40 between the front and back of edges 52 and 54 to facilitate attaching bracket 74 and increase the clamping and frictional forces generated when bracket 74 slides down onto brim 30. The increased thickness 126 at the bottom of mount 40 (e.g., adjacent lower circumference 34) wedges protrusions 120 into slots 78 and increases the frictional and clamping forces of the slots 78 and extensions 80 on bracket 74 enclosing edges 52 and 54 of mounts 40.

Figure 7:
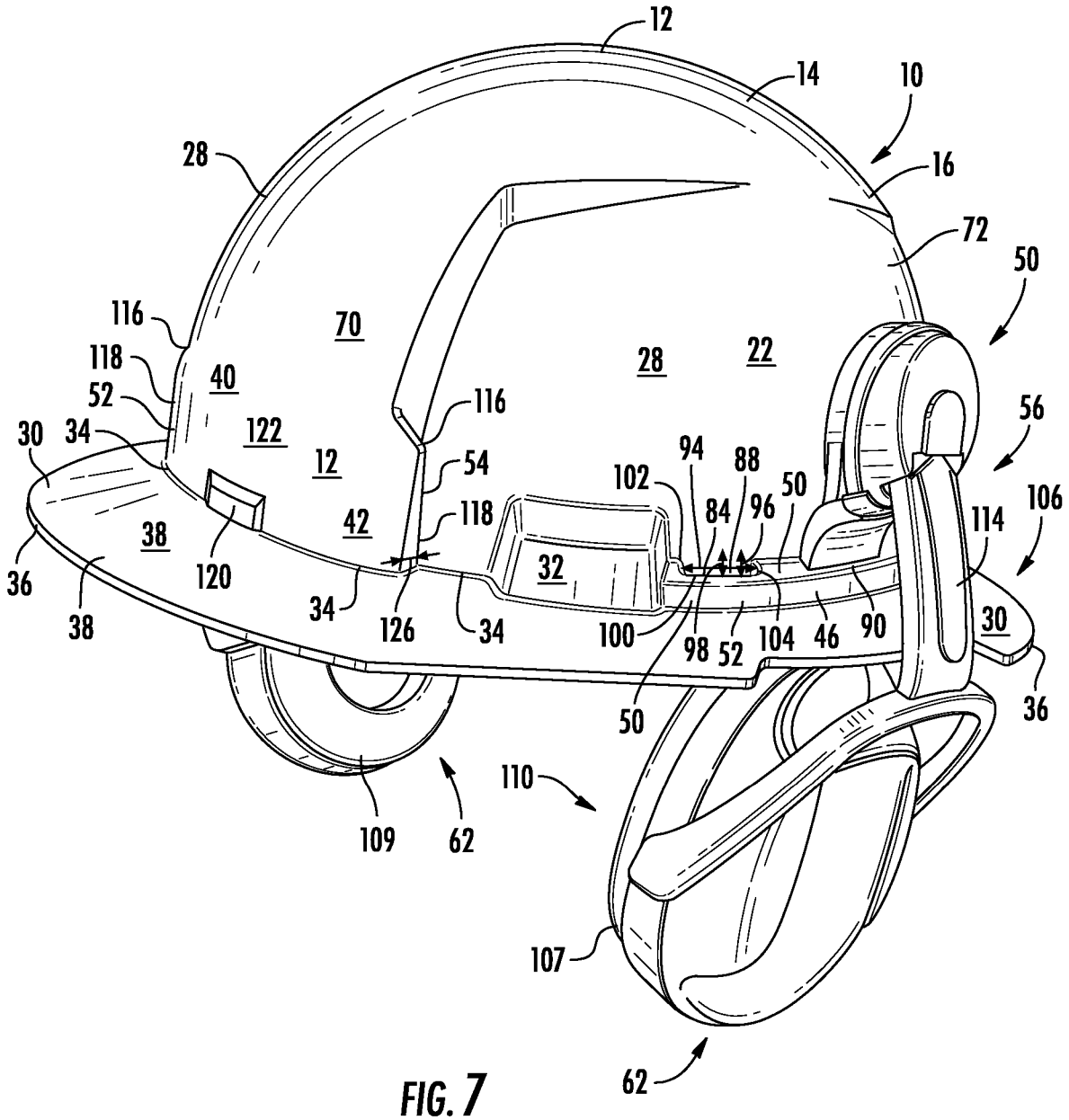
FIG. 7 is a perspective view of the earmuff accessory attachment with the clip coupled to the accessory ridge of the hard hat, according to an exemplary embodiment.

FIG. 7 shows a pair of earmuffs 62 coupled to opposite (e.g., left and right) accessory ridges 50. Earmuffs 62 include a right over-ear cuff 107 and a left over-ear cuff 109 coupled to middle ports 88 of accessory ridge 50 on hard hat 12. In various embodiments, the right and/or left ear cuffs 107 and/or 109 are coupled to middle accessory port 90 and/or rear accessory port 92 on both right side accessory ridge 46 and left accessory ridge 48 (e.g., on left/right side accessory ridges 50 of brim 30). This configuration adequately supports the weight of earmuffs 62 and enables a user to rotate the earmuffs 62 back off the user's ears. Also, front accessory port 88 remains available for another attachment 56.

Figure 8:
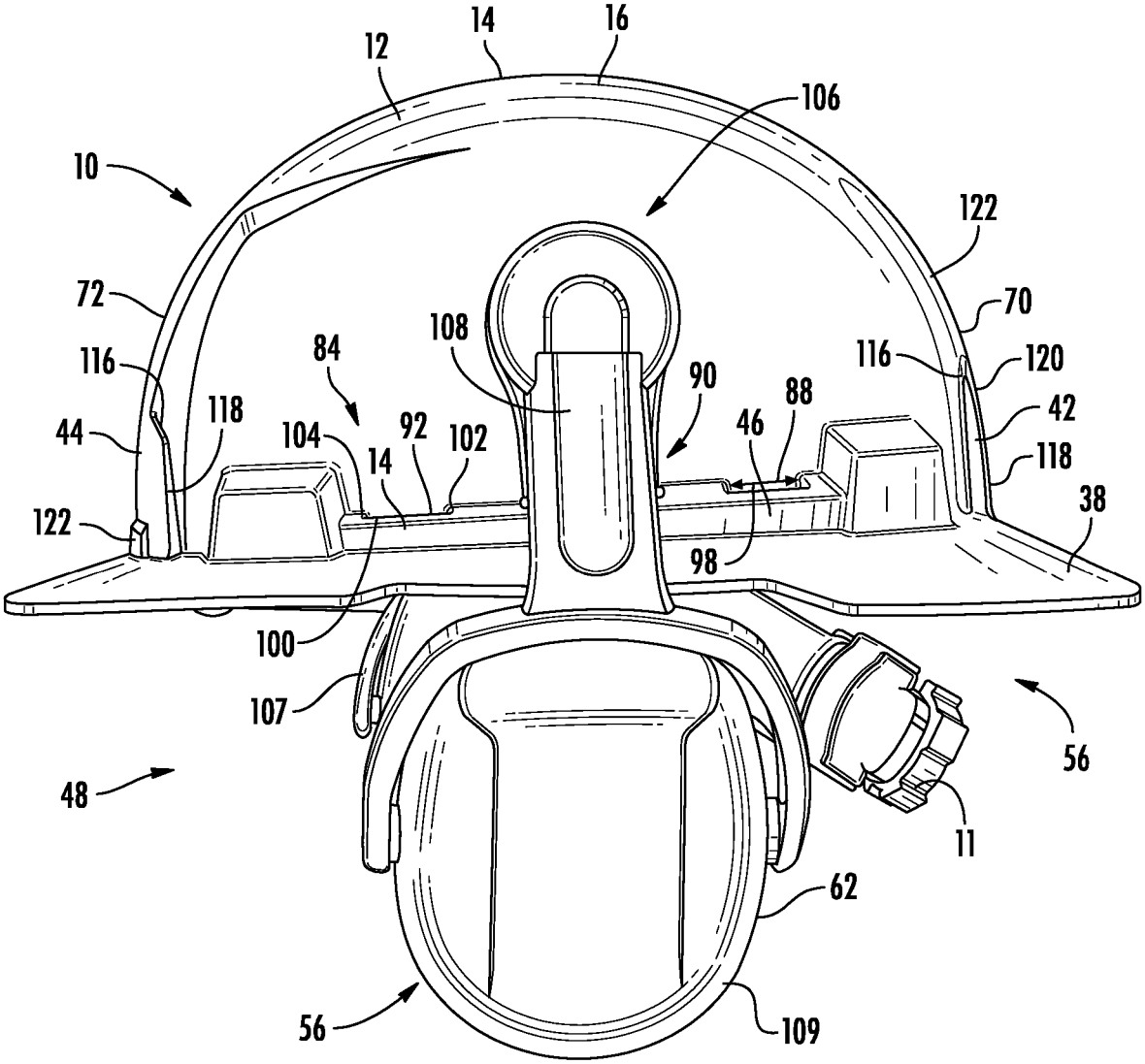
FIG. 8 is a side view of the earmuff attachment coupled to the hard hat of FIG. 7, according to an exemplary embodiment.

FIG. 8 shows a side view of the over-earmuffs 62 of FIG. 7. As shown in FIGS. 7 and 8, mounts 40 the in front and back of hard hat 12 remain available for customizable attachment of various attachments 56. Several customizable features of the attachment system 10 at accessory ridges are shown. Specifically, clips 86 on over-earmuffs 62 releasably couple to ports 88 and/or 90 on accessory ridge 50 of hard hat 12. Swivel 106 and/or sliding adjustments 114 enable adjusting the fit of earmuffs 62 to the user's head configuration. This creates a reliable and secure customizable fit for the operator and enhances user compliance and comfort. In addition, the releasable and replaceable nature of the hardware enhances the tools and attachments 56 an operator can select from for the specific environment or task. This enhances efficiency since the operator customizes equipment/tools for the specific job, environment, or other specific use of hard hat 12.

Figure 9:
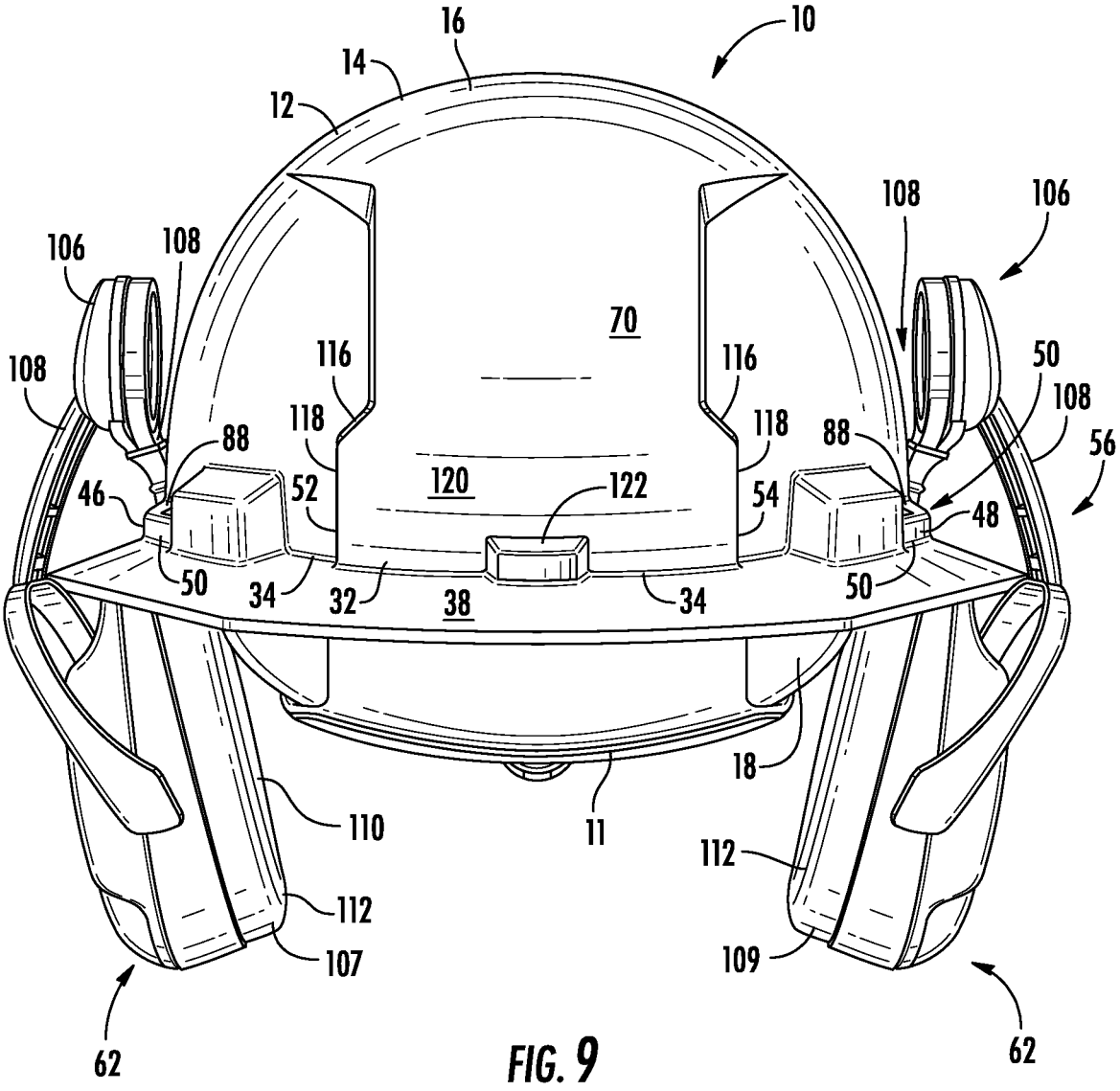
FIG. 9 is a front view of the earmuff accessory coupled to the hard hat, according to an exemplary embodiment.

FIG. 9 shows a front view of the right and left over-earmuffs 107 and 109. As shown in FIG. 9, a protrusion 120 is used to secure optional accessories on the front or back mounts 42 or 44. Swivel 106 includes a clip 86 that releasably couples to a clip attachment or port 84 to easily attach, remove, and replace attachments 56 and customize the location and fit of each over-earmuff 62 for a particular operator. Earmuff 62 attaches to the hard hat 12 with clip 86 inserted into one or more accessory ports 84 on support or accessory ridge 50 located on one side of hard hat 12. Attachment clip 86 releasably and securely couples earmuff 62 so that earmuff 62 can also be attached into a headband or over-head support 105. Hard hat attachment system 10 permits the user to optionally select/wear earmuffs 62 with or without hard hat 12.

Figure 10:
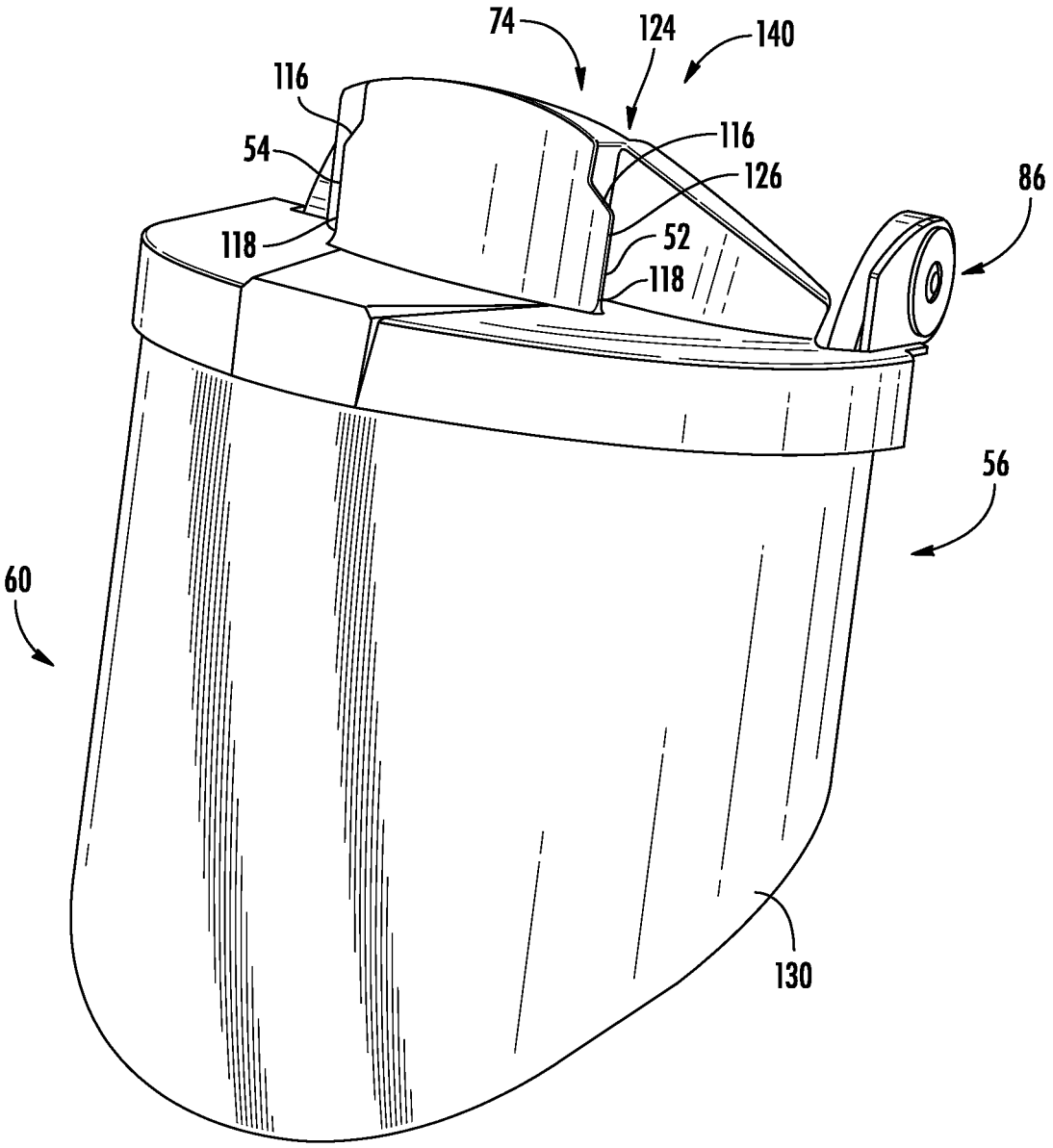
FIG. 10 shows a face-shield with lamp attachment mounting brackets, according to an exemplary embodiment.

FIG. 10 shows face-shield 60 with exterior mount 140, the same as or similar to mount 40 on hard hat 12. Exterior mount 140 and/or mount 40 on face-shield 60 and/or hard hat 12 receive bracket 74 on one or more edges 52 and 54 to couple the attachment 56 to hard hat 12 and/or face-shield 60. In this way, the same attachments 56 that couple to mounts 40 on hard hat 12 also couple to exterior mounts 140 on the coupled/mounted face-shield 60.

In some embodiments, face-shield 60 includes a face mask 130 comprising a transparent glass, polyurethane, or polymer to protect the operator's face and/or eyes from debris. In other embodiments, face mask 130 is substantially opaque, e.g., for wielding, limiting one or more wavelengths of light that pass through mask 130 to protect the operator's eyes. Face-shield 60 and/or mask 130 protect the operator's face and/or eyes from debris, temperature, light, liquids, and/or chemicals. In some embodiments, face-shield 60 includes an attachment clip 86 that further secures face-shield 60 against hard hat 12, e.g., at accessory ridge 50. For example, face-shield 60 includes bracket 74 that couples to mount 40 and accessory clip 86 that couples to left/right accessory ports 84 (e.g., front, middle, and/or rear accessory ports 88, 90, and/or 92) on accessory ridge 50 of hard hat 12. Face-shield 60 further comprises exterior mount 140 used to couple attachments 56 (e.g., lamp 58).

FIG. 10 shows face-shield 60 supporting lamp 58 on mount 40 of face-shield 60, where face-shield 60 is coupled to mounts 40 on hard hat 12. Mount 40 on face-shield 60 is the same or substantially the same as mount 40 on hard hat 12, such that attachments 56 with bracket 74 couple to either mount 40 on hard hat 12 and/or face-shield 60. In some embodiments, swivel 106 is located between face-shield 60 and clip 86 to facilitate the movement of face-shield 60. For example, after welding a part, an operator may lift face-shield 60 to temporarily look at the welded part, take a break, etc.

Figure 11:
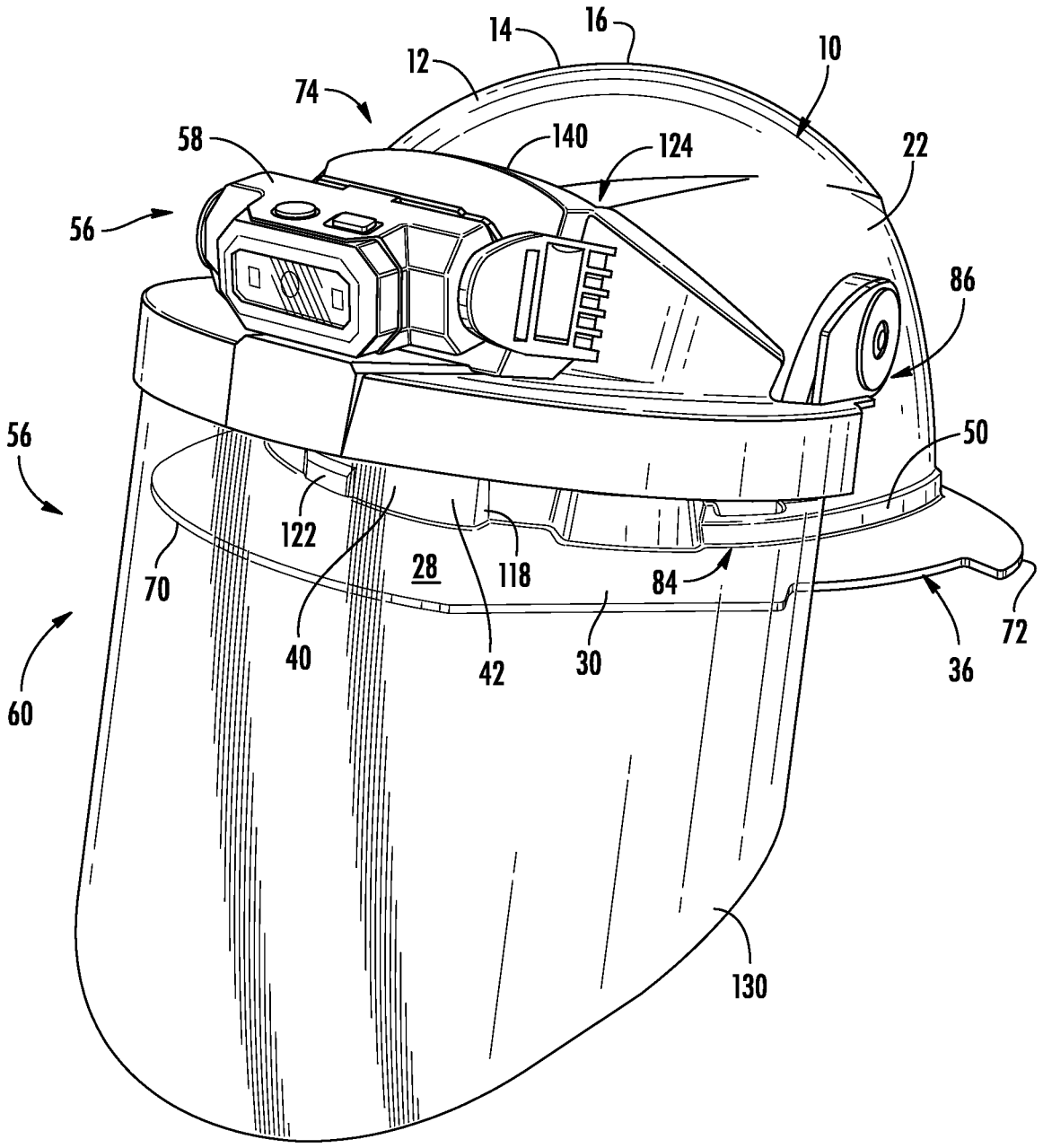
FIG. 11 shows the face-shield coupled to a hard hat and a lamp accessory, according to an exemplary embodiment.

FIG. 11 shows the configuration of hard hat 12 shown in FIG. 10, further including earmuffs 62 coupled to ports 84 on accessory ridges 50. In this configuration, lamp 58 is coupled to external mount 140 on face-shield 60. Face-shield 60 is coupled to mount 40 on hard hat 12, and earmuffs 62 are coupled to accessory ridges 50 on opposite sides of hard hat 12. Additional mounts 40 and/or accessory ridges 50 support additional attachments 56 (e.g., reflectors 64, tool carriers 66, and/or eyeglass holders 68). One feature of hard hat attachment system 10 is a user's ability to customize or configure a hard hat 12 for the particular job, environment, and/or safety requirements of the task.

Figure 12:
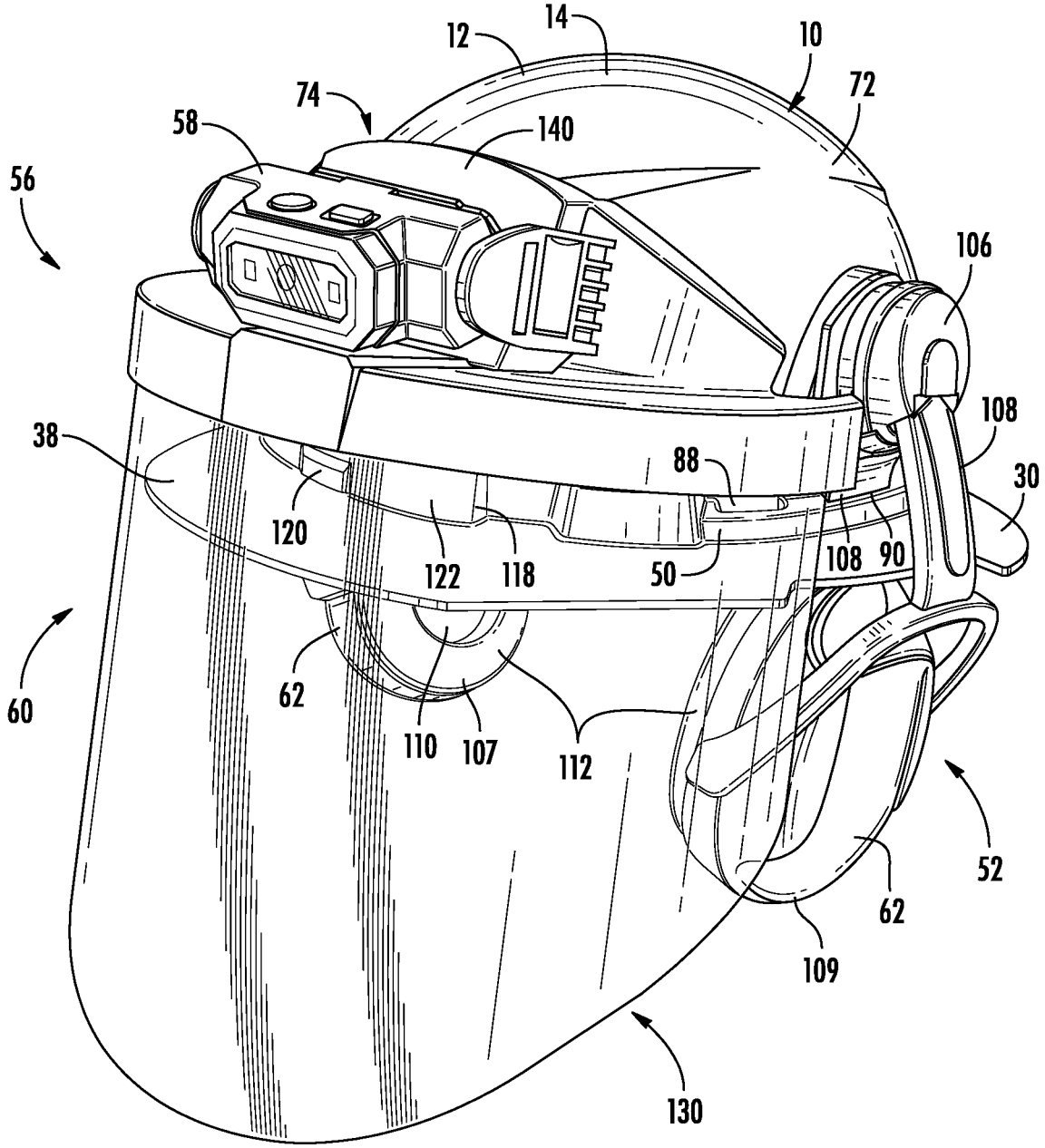
FIG. 12 shows a perspective view of the hard hat, including ear-muff, lamp, and face-shield accessories, according to an exemplary embodiment.

FIG. 12 shows various hard hat 12 reflective attachments 56. For example, mount 40 and side accessory ridge 50 each support one attachment 56 independently and cooperate to support a single attachment 56. Specifically, mount 40 supports lamp 58 on face-shield 60, and side accessory ridge 50 supports earmuffs 62 and cooperates with mount 40 to support face-shield 60. Mount 40 and front accessory ports 88 on side accessory ridge 50 support face-shield 60. Face shield 60 also supports lamp 58 on exterior mount 140 of face-shield 60. Earmuffs 62 are supported in middle accessory ports 90 of opposite side accessory ridges 50. Specifically, a clip 86 on earmuff 62 secures earmuff 62, and a connector 108 on face-shield 60 secures the face-shield in ports 84 of accessory ridge 50. In one embodiment, clip 86 on earmuff 62 is sized for middle accessory port 90, and connector 108 on face-shield 60 is sized for front accessory port 88.

In various embodiments, mounts 40 and accessory ridges 50 support various attachments 56 independently or cooperate to support the same attachment 56 (e.g., face-shield coupled to front mount 42 and front accessory ports 88).

Reflective hard hat attachments 56 or reflectors 64 improve the visibility and safety of the user. Reflective materials are attached to a support or reflector 64 with clip 86 to couple, snap, clip, and/or fit into accessory ridges 50 and/or ports 84 of hard hat 12. For example, reflectors 64 couple to front and rear accessory ports 88 and 92 of right and left accessory ridges 46 and 48. Inserts or clips 86 slide and clip into ports 84 on side accessory ridges 50 of hard hat 12. Similarly, reflectors 64 attach to brackets 74 and/or clips 86 that interact with front, back, or side accessory attachments (e.g., accessory ridges 46 and 48). For example, clips 86 and reflector 64 attachments are compatible with the BOLT accessory system 10 for hard hats 12 produced by Milwaukee Electric Tool Corp.

Figure 13:
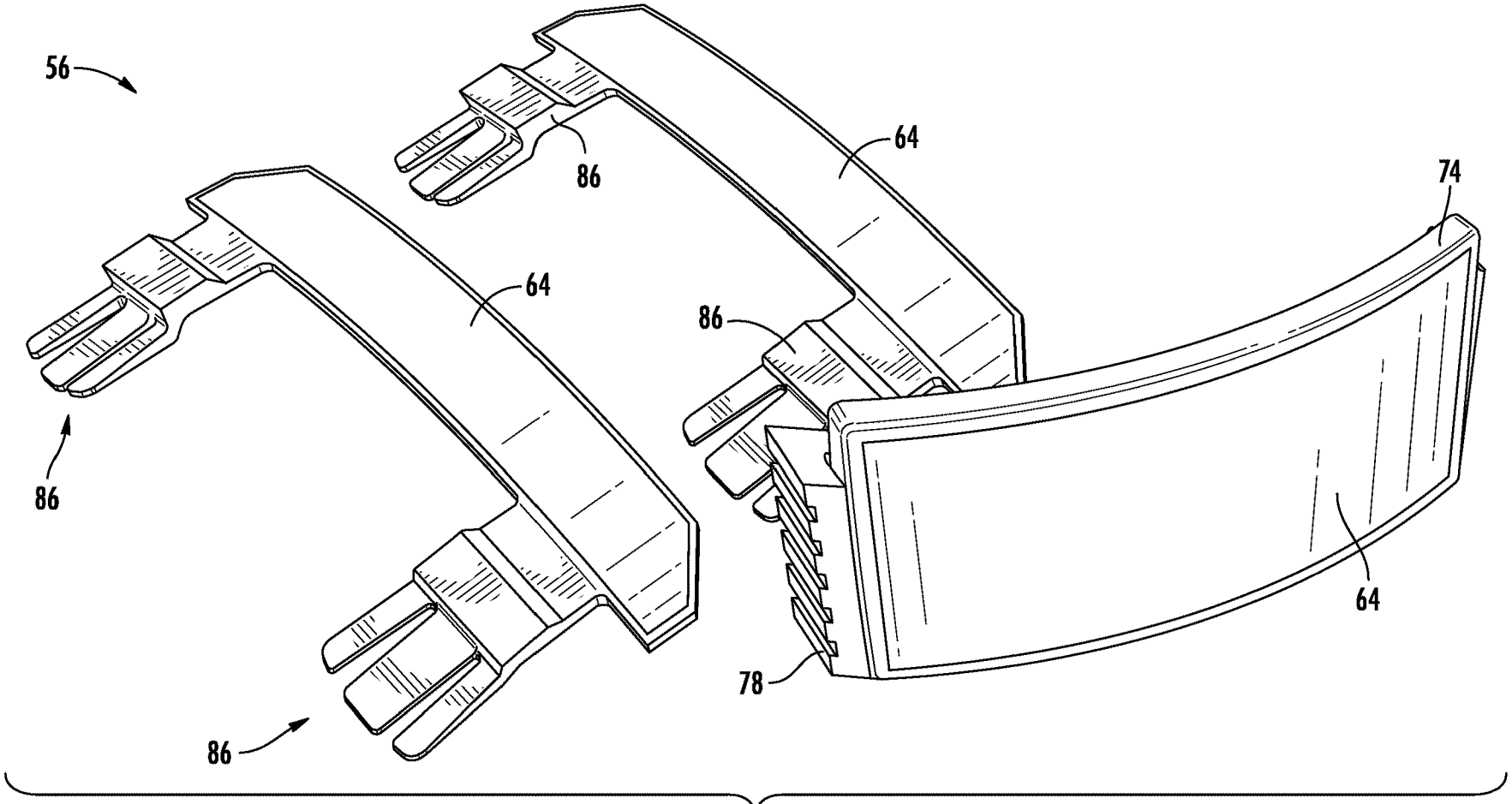
FIG. 13 shows reflective hard hat accessories that include reflective materials that couple to the mount and/or accessory ridge of the hard hat, according to an exemplary embodiment.

FIG. 13 shows the reflectors 64 of FIG. 12 coupled to hard hat 12. Reflective attachments 56 are shown coupled to ports 84 and mounts 40 of hard hat 12. Other mounting and auxiliary accessory ridges 46 and 48 are available to support other attachments 56 (e.g., earmuffs 62, lamps 58, tool carriers 66, etc.).

Figure 14:
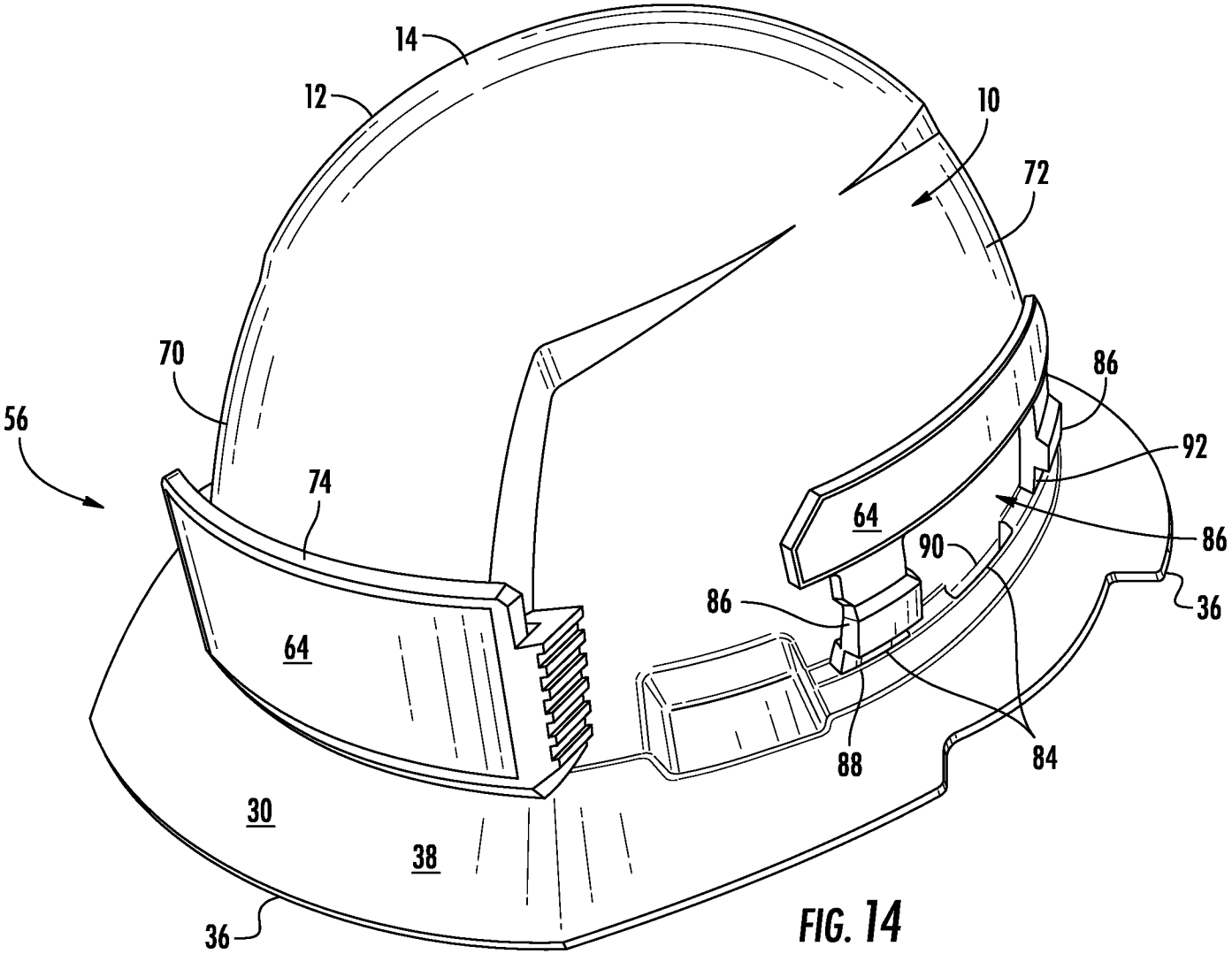
FIG. 14 shows the reflective accessories coupled to the mount and accessory ridge of the hard hat, according to an exemplary embodiment.

FIG. 14 shows a magnetic tool carrier 66 with various tools 132 (e.g., bits, screws, screwdrivers, etc.) that couple to the tool carrier 66. Ferro-magnetic tools 132 are attracted to the magnetic force in magnets within tool carrier 66 to hold or secure the tools 132 within slots of ports 84 of tool carrier 66. As shown, other ports 84 on side accessory ridges 50 are available for other attachments 56.

Figure 15:
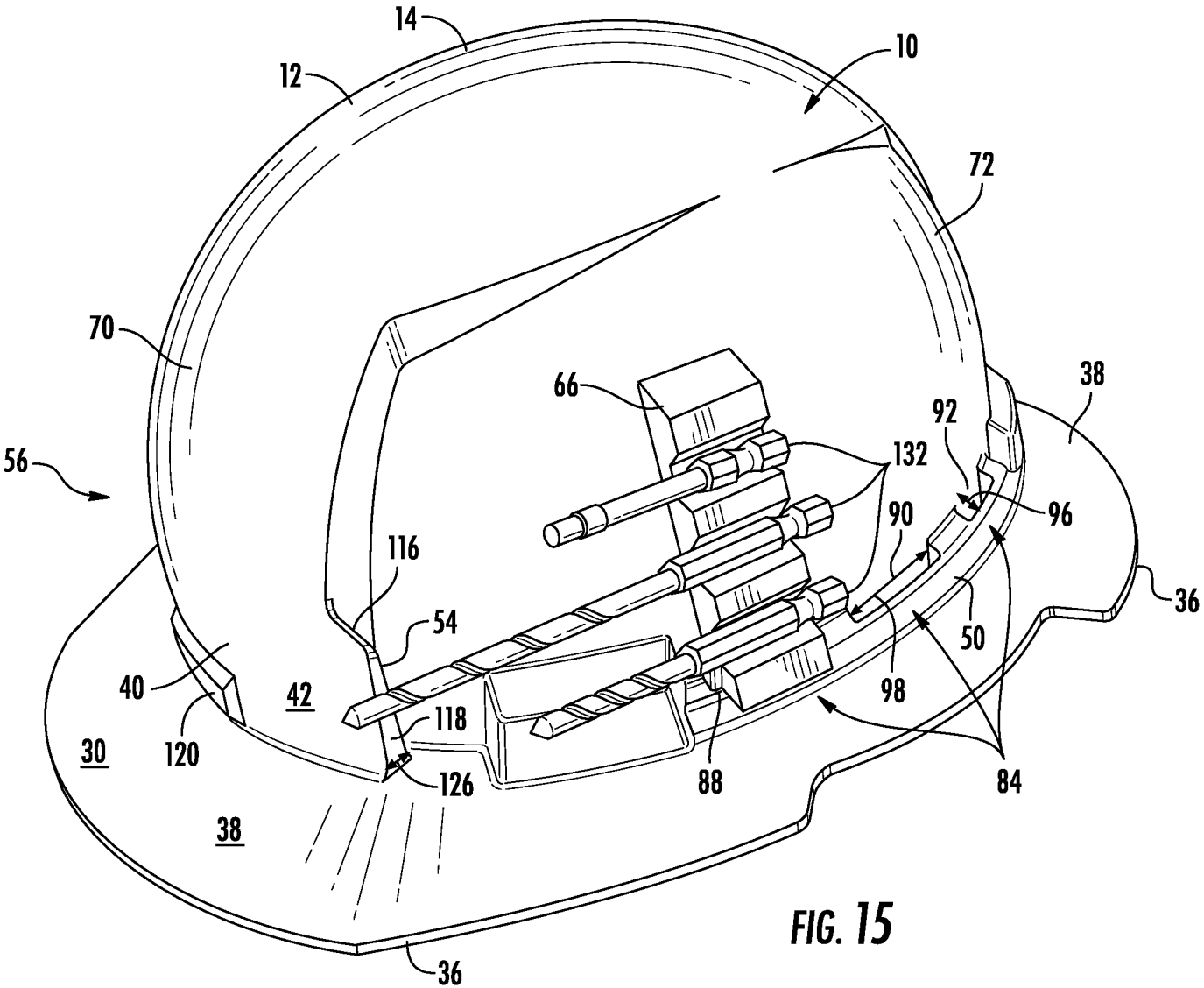
FIG. 15 shows a magnetic tool holder accessory coupled to a side receiving port of the accessory ridge on the hard hat, according to an exemplary embodiment.
Figure 16:
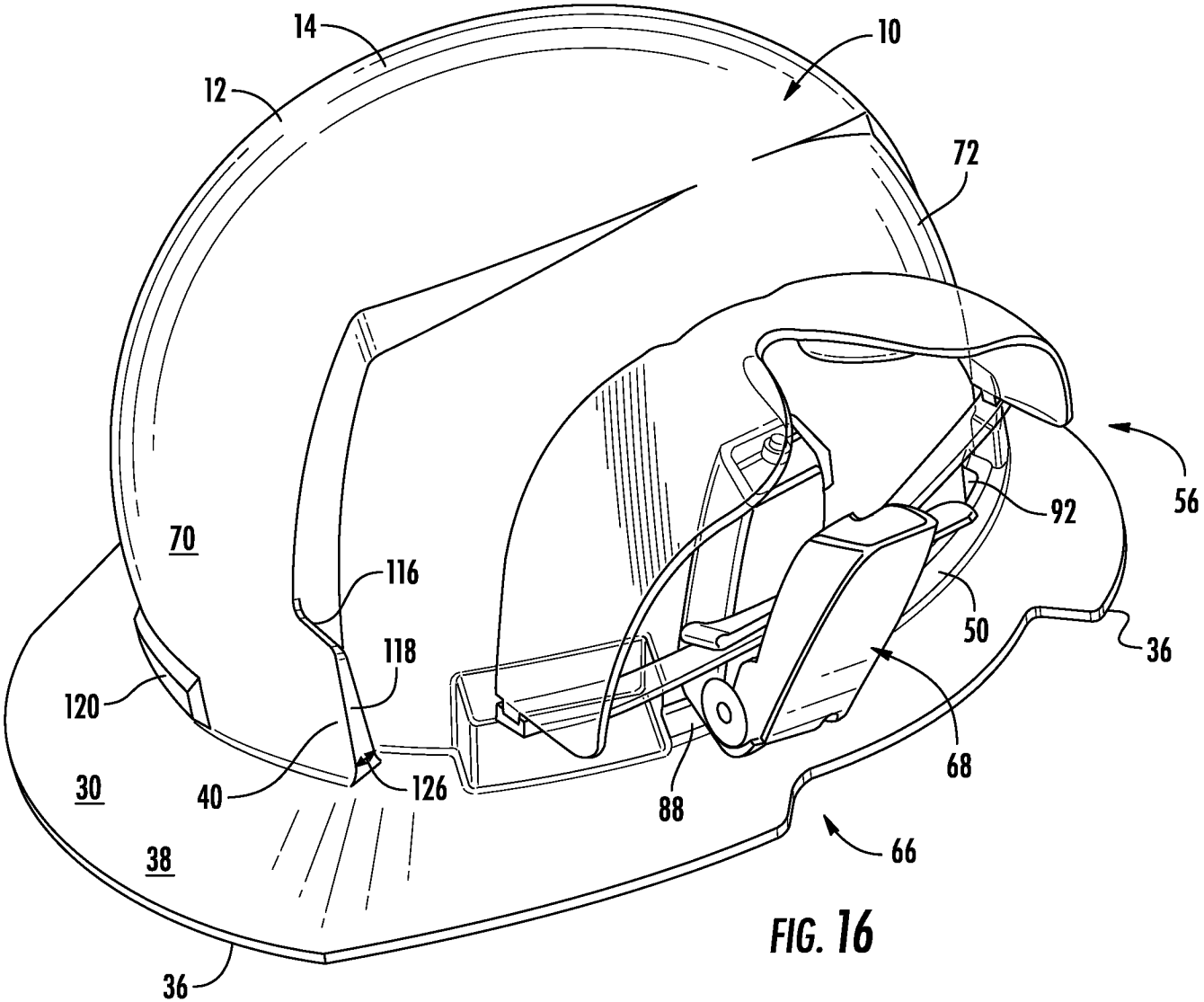
FIG. 16 shows an eyeglass holder attachment coupled to a side receiving port of the accessory ridge on the hard hat, according to an exemplary embodiment.

FIG. 15 shows an eyeglass holder 68 that the operator inserts into port 84 to store or carry a pair of eyeglasses. Similar holders 68 include other devices commonly carried, for example, keys, wallets, cell phones, rings, credit cards, and/or money holders 68. Attachment attachments 56 are customized to include holders 68 configured to carry a variety of devices for users. Holders 68 are configured with bracket 74 and/or clip 86 to couple to mounting or auxiliary accessory ridges 50 of hard hat 12.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

In various exemplary embodiments, the relative dimensions, including angles, lengths, and radii, as shown in the figures, are to scale. Actual measurements of the Figures will disclose relative dimensions, angles, and proportions of the various exemplary embodiments. Various exemplary embodiments extend to various ranges around the absolute and relative dimensions, angles, and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements. The position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes, and omissions may also be made in the design, operating conditions, and arrangement of the various exemplary embodiments without departing from the scope of the present invention.

What is claimed is:

1. A hard hat, comprising:
an outer shell comprising:
an exterior surface;
an interior surface defining a cavity configured to receive a head of an operator; and
a lower circumference extending along the exterior surface of the outer shell; and
a side accessory ridge coupled to a lateral side of the exterior surface and extending along the lower circumference, the side accessory ridge comprising:
a front accessory port with a first length;
a middle accessory port with a second length; and
a rear accessory port having a third length, wherein the second length is different from the first length and the third length.

2. The hard hat of claim 1, further comprising a brim extending radially outward and away from at least a portion of the lower circumference.

3. The hard hat of claim 1, further comprising an attachment coupled to the side accessory ridge, wherein the attachment is selected from a reflector, a magnetic tool carrier, a face-shield, earmuffs, and an eyeglass holder.

4. The hard hat of claim 1, further comprising an opposite side accessory ridge, wherein the side accessory ridge and the opposite side accessory ridge extend around opposite lateral sides of the exterior surface along the lower circumference of the outer shell.

5. The hard hat of claim 4, further comprising a pair of earmuffs with a left earmuff and a right earmuff, wherein the right earmuff is coupled to the middle accessory port of the side accessory ridge, and the left earmuff is coupled to a middle accessory port of the opposite side accessory ridge.

6. The hard hat of claim 1, further comprising a side clip coupled to one of the front accessory port, the middle accessory port, or the rear accessory port of the side accessory ridge to secure an attachment to the hard hat.

7. The hard hat of claim 1, further comprising a mount on at least one of a front portion and a rear portion of the exterior surface, wherein the mount and the side accessory ridge each support an attachment.

8. The hard hat of claim 7, wherein the same attachment engages both the mount and the side accessory ridge.

9. A hard hat, comprising:
an outer shell comprising:
an exterior surface;
an interior surface defining a cavity configured to receive a head of an operator; and
a crown segment configured to cover part of the head of the operator, wherein a bottom portion of the crown segment defines a lower circumference along the exterior surface of the outer shell; and
a side accessory ridge located at the bottom portion of the crown segment, the side accessory ridge comprising:
a front port with a first width;
a rear port with a second width; and
a middle port with a third width;
wherein the first width is the same as the second width and the third width.

10. The hard hat of claim 9, wherein the side accessory ridge extends entirely along the bottom portion of the crown segment.

11. The hard hat of claim 9, further comprising:
a first port length for the front port;
a second port length for the rear port; and
a third port length for the middle port;
wherein the third port length is different from the first port length and the second port length.

12. The hard hat of claim 11, wherein the third port length is greater than the first port length and the second port length.

13. The hard hat of claim 11, wherein the first port length of the front port is the same as the second port length of the rear port.

14. The hard hat of claim 9, further comprising a front mount extending from the outer shell, a rear mount extending from the outer shell, and an opposite side accessory ridge extending from the outer shell, and wherein the side accessory ridge and the opposite side accessory ridge both extend along the bottom portion of the crown segment.

15. The hard hat of claim 9, wherein the front port or rear port couple to a reflector, and wherein the reflector includes a clip sized for the front port or the rear port.

16. A hard hat, comprising:
an outer shell comprising:
a left lateral outer surface;
a right lateral outer surface;
an interior surface defining a cavity; and
a crown segment configured to cover part of a head of an operator, wherein a bottom portion of the crown segment defines a lower circumference of the outer shell; and
a brim extending radially outward from a portion of the lower circumference;
a left side accessory ridge located on the left lateral outer surface of the outer shell and extending along the lower circumference, the left side accessory ridge comprising:
a front left side accessory port;
a middle left side accessory port; and
a rear left side accessory port; and
a right side accessory ridge located on the right lateral outer surface of the outer shell and extending along the lower circumference, the right side accessory ridge comprising:
a front right side accessory port;
a middle right side accessory port; and
a rear right side accessory port.

17. The hard hat of claim 16, the left side accessory ridge further comprising:
a first end; and
a second end opposing the first end, wherein the left side accessory ridge extends between the first end and the second end; and
wherein the front left side accessory port, the middle left side accessory port, and the rear left side accessory port are located between the first end and second end of the left side accessory ridge.

18. The hard hat of claim 16, further comprising:
a front mount, comprising:
a left edge protruding outwardly from the front mount;
a right edge opposite the left edge, the right edge protruding outwardly from the front mount; and
a detent positioned between the left edge and the right edge; and
a rear mount, comprising:
a left edge protruding outwardly from the front mount;
a right edge opposite the left edge, the right edge protruding outwardly from the front mount; and
a detent positioned between the left edge and the right edge.

19. The hard hat of claim 18, further comprising:

the right side accessory ridge comprising:

a third end; and a fourth end opposing the third end, wherein the right side accessory ridge extends between the third end and the fourth end; and wherein the third end and fourth end are positioned between front mount and rear mount.

20. The hard hat of claim 18, wherein the front mount, the front left side accessory port, and the front right side accessory port each support an accessory.

* * * * *